US007766720B2

(12) United States Patent
Ostendorff

(10) Patent No.: US 7,766,720 B2
(45) Date of Patent: Aug. 3, 2010

(54) PLAY SET FOR TOY VEHICLES

(75) Inventor: Eric C. Ostendorff, Torrance, CA (US)

(73) Assignee: Mattel Inc., El Segundo, CA (US)

( * ) Notice: Subject to any disclaimer, the term of this patent is extended or adjusted under 35 U.S.C. 154(b) by 305 days.

(21) Appl. No.: 11/855,650

(22) Filed: Sep. 14, 2007

(65) Prior Publication Data

US 2009/0072481 A1 Mar. 19, 2009

(51) Int. Cl.
*A63H 18/00* (2006.01)

(52) U.S. Cl. ..... 446/444; 446/445; 446/446; 446/447; 446/429; 446/430; 446/455; 446/168; 446/169; 446/170; 446/171; 446/172; 446/173; 446/174; 273/246; 463/6; 463/58; 463/59

(58) Field of Classification Search ..... 273/246; 446/429, 430, 444–447, 455, 168–174; 463/6, 463/58–59
See application file for complete search history.

(56) References Cited

U.S. PATENT DOCUMENTS 1,886,484 A * 11/1932 Kline ..... 104/305
3,135,632 A * 6/1964 Lucas et al. ..... 134/28
3,228,600 A * 1/1966 May ..... 235/99 R
3,315,632 A * 4/1967 Hyden ..... 116/223
3,400,667 A 9/1968 Case et al.
3,476,389 A 11/1969 Hok-Shou
3,510,631 A 5/1970 Parker et al.
3,531,118 A 9/1970 Mabie et al.
3,565,430 A 2/1971 McRoskey
3,588,107 A 6/1971 Kupperman
3,618,397 A * 11/1971 Bosley et al. ..... 73/488

(Continued)

FOREIGN PATENT DOCUMENTS

GB 2123190 A 1/1984

(Continued)

OTHER PUBLICATIONS

Written Opinion dated Apr. 9, 2009 for International Application No. PCT/US2008/076213 International Filing Date Sep. 12, 2008.

(Continued)

*Primary Examiner*—Gene Kim
*Assistant Examiner*—Alexander R Niconovich
(74) *Attorney, Agent, or Firm*—Cantor Colburn LLP

(57) ABSTRACT

A racing play set for toy vehicles includes a first track segment, a second track segment disposed in intersection with the first track segment, a return portion disposed in communication with the first and second track portions, and a scoring mechanism, where the return portion is configured to be shared by toy vehicles traveling on the first and second track segments, where the return portion is configured to receive a first toy vehicle from the first track segment and return the first vehicle to the first track segment, where the return portion is configured to receive a second toy vehicle from the second track segment and return the second vehicle to the second track segment, where the scoring mechanism is configured to record a pass of the first vehicle through the return portion and a pass of the second vehicle through the return portion.

20 Claims, 4 Drawing Sheets

U.S. PATENT DOCUMENTS 3,628,725 A * 12/1971 Edwards et al. ..... 235/29 R
3,667,672 A 6/1972 Kennedy et al.
3,697,071 A * 10/1972 Anderson ..... 463/60
3,712,615 A * 1/1973 Staats et al. ..... 463/59
3,762,095 A * 10/1973 Merino et al. ..... 446/430
3,775,897 A * 12/1973 Soulakis et al. ..... 446/487
3,860,238 A * 1/1975 Kojima ..... 463/59
3,998,460 A * 12/1976 Dyer ..... 463/64
4,070,024 A 1/1978 Hamano
4,108,437 A * 8/1978 DeAnda et al. ..... 463/59
4,146,991 A * 4/1979 Sano ..... 446/430
4,330,127 A * 5/1982 Brand et al. ..... 463/59
4,364,566 A * 12/1982 Neuhierl ..... 463/6
4,366,374 A * 12/1982 Neuhierl ..... 235/93
4,403,440 A * 9/1983 Wulff ..... 446/430
4,408,413 A * 10/1983 Hyland et al. ..... 446/138
4,423,871 A * 1/1984 Mucaro ..... 463/64
4,513,966 A * 4/1985 Mucaro et al. ..... 238/10 F
4,513,967 A * 4/1985 Halford et al. ..... 273/108
4,564,197 A * 1/1986 Lambert et al. ..... 463/64
4,575,346 A * 3/1986 Ogawa ..... 446/259
4,605,229 A 8/1986 McKay
4,605,230 A * 8/1986 Halford et al. ..... 273/129 AP
4,690,658 A * 9/1987 Crosson et al. ..... 446/429
4,715,602 A * 12/1987 May et al. ..... 463/60
4,715,843 A * 12/1987 Ostendorff et al. ..... 446/429
4,925,188 A * 5/1990 McKay et al. ..... 463/59
5,234,216 A * 8/1993 Ostendorff ..... 273/127 A
5,254,030 A * 10/1993 Ostendorff et al. ..... 446/430
5,586,923 A * 12/1996 Hippely et al. ..... 446/14
5,643,040 A * 7/1997 Hippely et al. ..... 446/429
5,651,736 A 7/1997 Myers
5,676,586 A * 10/1997 James ..... 446/444
5,707,061 A * 1/1998 Ikeda et al. ..... 273/145 R
5,865,435 A * 2/1999 Ikeda et al. ..... 273/145 R
5,899,789 A * 5/1999 Rehkemper et al. ..... 446/444
6,000,992 A * 12/1999 Lambert ..... 446/430
6,435,929 B1 * 8/2002 Halford ..... 446/6
6,676,480 B2 * 1/2004 Sheltman ..... 446/429
6,695,675 B1 * 2/2004 Ngan ..... 446/429
6,951,497 B1 * 10/2005 Ngan ..... 446/444
7,086,922 B2 8/2006 Delgado
7,241,223 B1 7/2007 Caudill
7,537,509 B2 * 5/2009 Payne et al. ..... 446/444
2005/0191938 A1 * 9/2005 Sheltman et al. ..... 446/429
2005/0191940 A1 * 9/2005 Sheltman et al. ..... 446/437
2005/0287916 A1 * 12/2005 Sheltman et al. ..... 446/444
2005/0287919 A1 * 12/2005 Sheltman et al. ..... 446/444
2007/0049160 A1 * 3/2007 Matthes et al. ..... 446/444
2007/0149090 A1 * 6/2007 Hippely ..... 446/445
2007/0197127 A1 * 8/2007 Ostendorff et al. ..... 446/433
2007/0293122 A1 * 12/2007 O'Connor et al. ..... 446/429
2008/0012227 A1 * 1/2008 O'Hara ..... 273/292
2008/0113585 A1 * 5/2008 Payne et al. ..... 446/444
2008/0265048 A1 * 10/2008 O'Connor ..... 238/10 E
2008/0268743 A1 * 10/2008 O'Connor et al. ..... 446/429
2009/0075558 A1 * 3/2009 Ostendorff ..... 446/444

FOREIGN PATENT DOCUMENTS

JP 02031782 A 2/1990
WO 9201497 A1 2/1992

OTHER PUBLICATIONS

International Search Report dated Apr. 9, 2009 for International Application No. PCT/US20081076213 International Filing Date Sep. 12, 2008.

* cited by examiner

PLAY SET FOR TOY VEHICLES

BACKGROUND

Play sets for toy vehicles are known to be popular toys. These play sets allow toy vehicles, such as 1/64 scale die cast metal toy vehicles, to be propelled through various track configurations at relatively high speeds. The vehicles may be propelled by hand, by launcher arrangement, by gravity, etc.

Some track arrangements include counters that count the number of passes, laps, etc. which a toy vehicle may make. Such counters introduce the concept of racing and allow the players, each of which controls a corresponding toy vehicle, to compete against each other.

However, most conventional play sets are basically passive, even where lap counters introduce an element of competition. That is, generally, the vehicles are simply placed in the play sets and set in motion. The vehicles often cannot be subsequently interacted with during a competitive race. Such sets do not require skill or timing on the part of the player. Moreover, existing counters simply tally lap totals during competition and do not provide a true head-to-head competitive experience where, for example, one player's advancement toward a goal may result an opposing player's regression.

Accordingly, a play set is desired for toy vehicles which provides the excitement of a potential collision course and which provides a true and enhanced head-to-head competitive experience.

BRIEF SUMMARY OF INVENTION

In accordance with an embodiment of the present invention, a play set for toy vehicles includes a first track segment, a second track segment disposed in intersection with the first track segment, a return portion disposed in communication with the first and second track portions, and a scoring mechanism, where the return portion is configured to be shared by toy vehicles traveling oh the first and second track segments, where the return portion is configured to receive a first toy vehicle from the first track segment and return the first vehicle to the first track segment, where the return portion is configured to receive a second toy vehicle from the second track segment and return the second vehicle to the second track segment, where the scoring mechanism is configured to record a pass of the first vehicle through the return portion and a pass of the second vehicle through the return portion.

In another embodiment of the invention, a racing play set includes a plurality of tracks which intersect at least once and which are configured to allow movable toys to travel in initially convergent directions and then in subsequent divergent directions absent a collision event, a scoring apparatus that is actuated by a leading non-colliding toy to record a score for a player corresponding to the leading non-colliding toy, and a launcher (or booster) disposed at a launching position of each track from which the toys are propelled in the convergent direction and to which the non-colliding toys returns, the launcher configured to be manually actuated by a player.

The invention further provides a racing play set for non-motorized toy vehicles including a plurality of track segments, each having corresponding first and second ends, launcher arrangements disposed at the respective first ends of the track segments and configured to allow selective propulsion of the toy vehicles traveling on the track segments in a direction toward the second ends, a hub disposed at the second ends of the track segments and including an intersection portion where the track segments converge and a return portion including a single track shared by the plurality of track segments and configured to redirect the toy vehicles toward the launcher arrangements and a scoring mechanism configured to indicate a score to a vehicle which passes through at least one of the intersection and the return portion and further configured to correspondingly detract a score from a competing vehicle.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
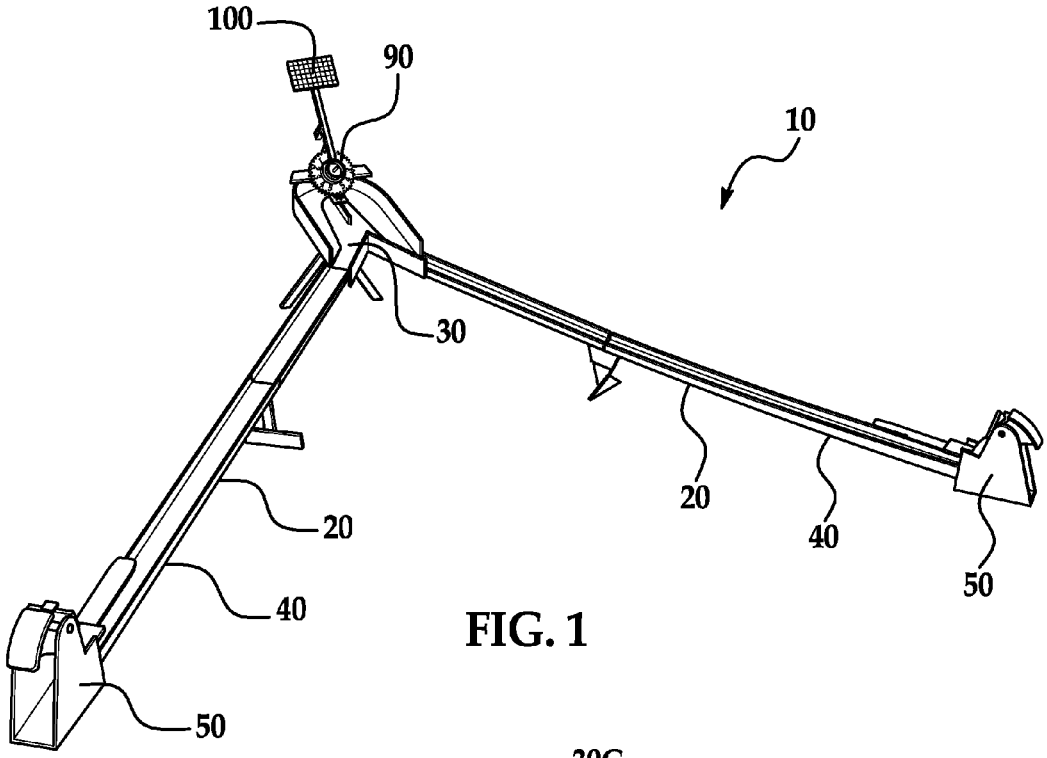
FIG. 1 illustrates a racing play set according to an embodiment of the invention.
Figure 2:
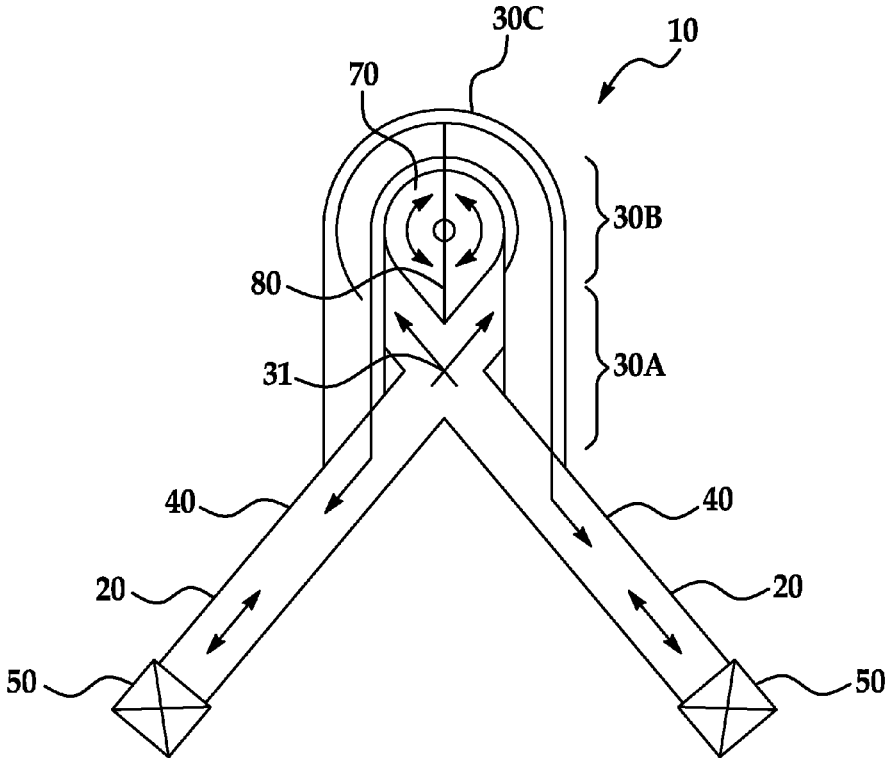
FIG. 2 illustrates a schematic plan view of the play set of FIG. 1.

As shown in FIGS. 1 and 2, a racing play set 10 for non-motorized toy vehicles according to an embodiment of the present invention includes two or more arms 20 and a hub 30. The hub 30 is elevated off of a support surface on which the racing play set 10 is set and the arms 20 extend outwardly from opposing sides of the hub 30 and back toward the surface in a generally V-shape orientation.

Each of the arms 20 includes a track 40 defined therein that extends along each of the arms 20 from distal ends thereof to proximate ends at the hub 30. In the hub 30, the tracks 40 intersect one another in a forward portion 30A, curve inwardly in a middle portion 30B and then join in a rear portion 30C. (See, e.g., FIG. 2.) Each of the arms 20 also includes a launcher 50 (a booster) located at the distal ends of the tracks 40. In addition, side rails 60 are provided along the lengths of the tracks 40 and the outer edges of the hub 30 to decrease the risk of vehicle derailments.

When each launcher 50 is activated, such as when an external force is applied to the launcher 50 from above by a player, each launcher 505 launches a toy vehicle up the corresponding track 40. The vehicles then reach an intersection 31 of the tracks at the front portion 30A of the hub 30 where the vehicles will either collide with each other or pass through sequentially. The vehicles will then progress around the curves in the tracks 40 in the middle portion 30B and the rear portion 30C. In the event that the vehicles never collide, the vehicles are then urged around the curves in the tracks 40 by their forward momentum and the side rails 60 until they return to the proximate ends of tracks 40 before traveling down the arms 20 to return to the launchers 50. As explained further in detail further herein, a successful pass of a vehicle through the hub results in a score for the respective player.

In this way, each player must use skill and/or timing in launching his/her respective vehicle so as to either insure a collision between the vehicles that prevents the other player from scoring or to achieve a scoring run with his/her own vehicle.

Figure 5:
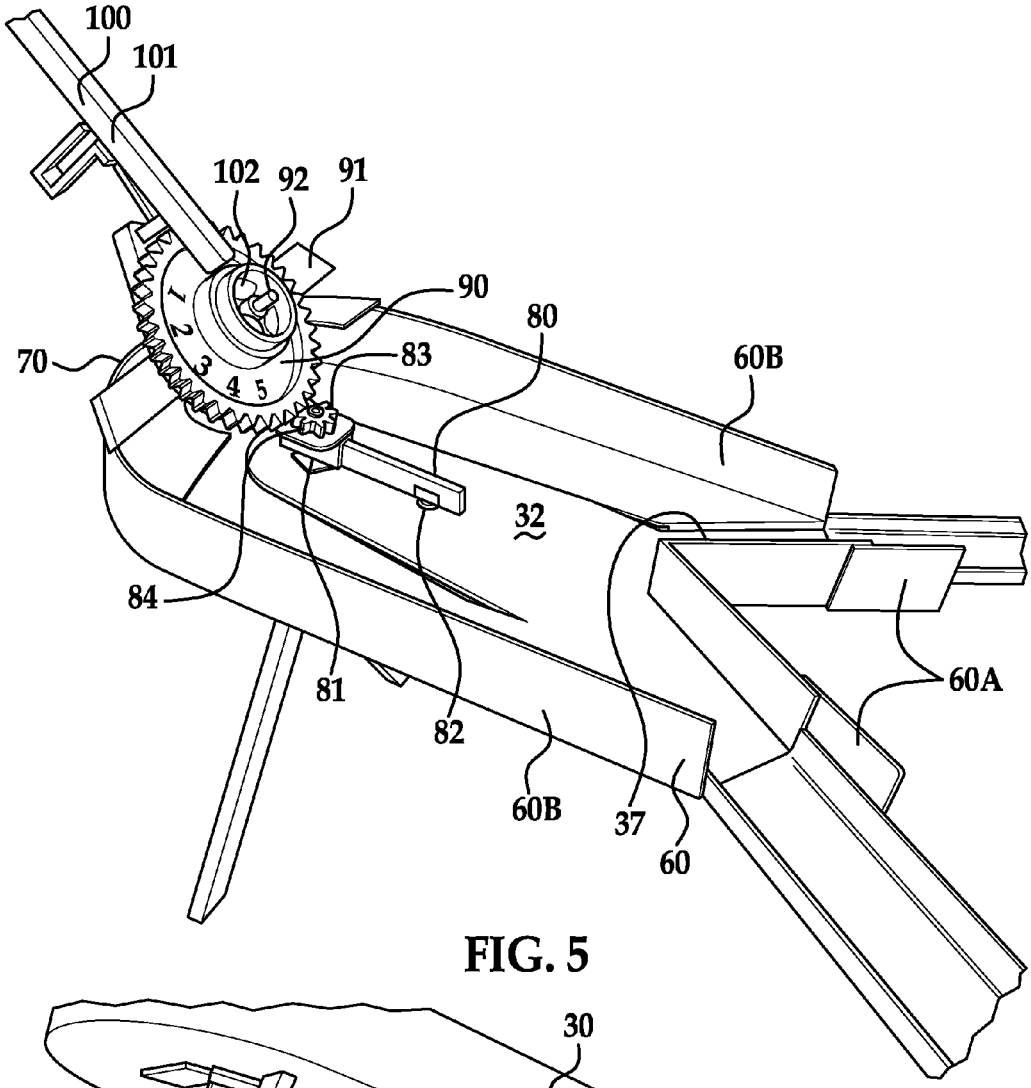
FIG. 5 is a top perspective view of a hub of the play segment shown in FIG. 1.

As shown in FIG. 5, a scoring mechanism in the hub 30 includes a turnstile mechanism 70 which includes a lever 80 that each vehicle rotates a half-turn as the vehicle runs through the hub 30. The vehicles in each track 40 rotate the lever in opposite directions, so that as one vehicle completes more laps, the lever is rotated more in one direction than the other. The lever 80 is geared to rotate a lap counting wheel 90 or a scoring indicator needle such that a half-turn rotation of the lever 80 corresponds to a single scoring event on the lap count wheel 90 by a certain number of laps. Initially, this lap counting wheel 90 is set at a center (zero) position to indicate that a race between two players is even. As the vehicles race, however, the lap counting wheel 90 will indicate one player's lead. While, there is no fixed number of laps to the race, in an embodiment of the invention, the race ends when the lead outpaces the numbering on the lap counting wheel 90. At this point a flag 100 drops to indicate the winner. For example, the counting wheel 80 may essentially include a dial including indicia 0-5 for each of two players. A neutral start position of the wheel 80 may indicate "0". As play commences the wheel 80 moves through indicia 1, 2, 3, etc. in the direction (clockwise or counter-clockwise) of a scoring player. When the scoring player moves the dial to indicia "5", the game is won. However, during the play, the opposing player may complete successful laps through the hub 30 thus turning the wheel 80 in the opposite direction, scoring for him/herself while detracting from the score of the other player.

Figure 3:
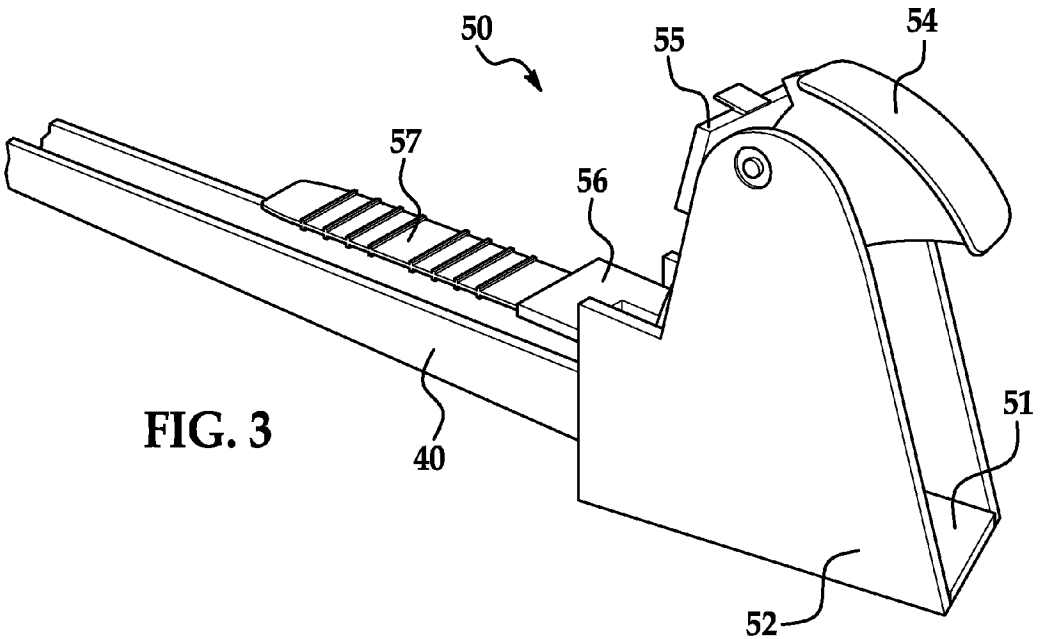
FIG. 3 illustrates a perspective view of a launcher arrangement of the play set of FIG. 1.

As shown in FIG. 3, the exemplary launchers 50 are manually powered and include a base 51, shoulders 52 and a swinging bar 53 extending between upper portions of the shoulders 52. An actuator 54 rotates about the swinging bar 53 upon an application of an external force, such as a player hitting the actuator 54 with a downward blow. The rotation is bounded in first and second directions by a forward and rear edges of a block 55 coupled to forward portions of the shoulders 52. Further, a front edge of the actuator 54 is guided along a center line of the corresponding track 40 by a guide 56 defined in a track cover 57 extending over the track 40. The launcher 50 can also be any such assembly known in the art to launch toy vehicles.

During operation, a vehicle is placed in the track 40 proximate to the launcher 50 and is accelerated along the track 40 when a player strikes the actuator 54 in a downward direction causing the actuator 54 to rotate about the swinging bar 53 and impact the vehicle. The vehicle is then propelled along the track 40 and is bounded by the track cover 57 and by the side rails 60 as it launches from the launcher 50 and traverses the length of the track 40.

Figure 4:
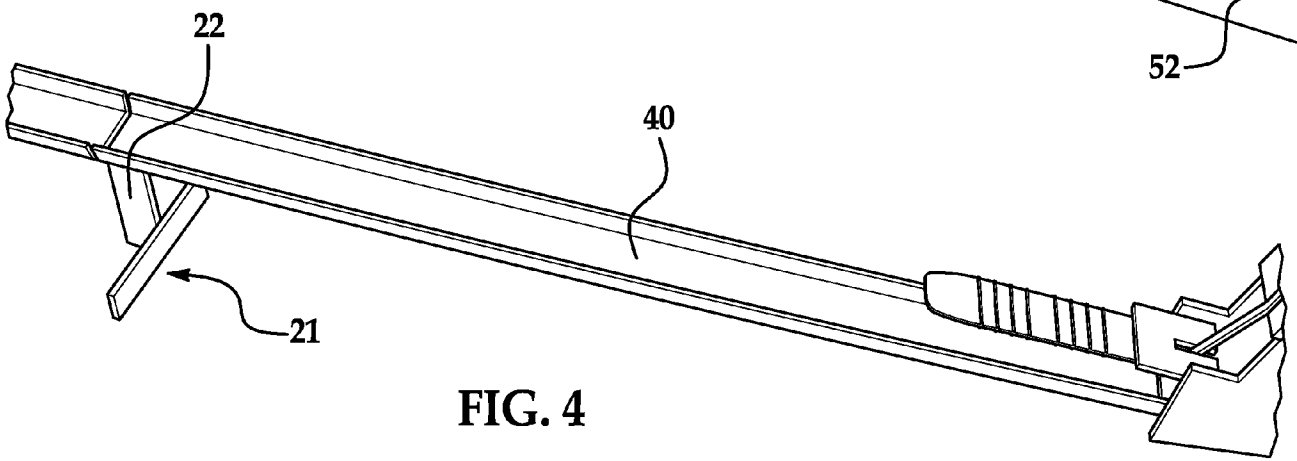
FIG. 4 illustrates a perspective view of a track segment of the play set of FIG. 1.

As shown in FIG. 4, the tracks 40 extend along the arms 20 and each gradually rise from the launchers 50 toward the hub 30. The side rails 60 bound each side of each of the tracks 40. In addition, each arm 20 is supported by track pedestals 21 at approximate midpoints 22. The track pedestals 211 each maintain the respective positions of the arms 20 during the operation of the racing play set 10 and reduce a bending of each track 40 due to gravity and/or the passage of a toy vehicle.

With reference now to FIGS. 2 and 5, it is noted that the hub 30 includes the forward portion 30A, the middle portion 30B and the rear portion 30C as well as an inlay 37 set in a bottom plate 32 of the hub 30 to define the position of the tracks 40 and to smoothly continue their respective paths into the hub 30. In addition, the hub 30 also includes a forward side rail 60A and a rear side rail 60B.

The lap counting wheel 90 of the turnstile mechanism 70 is supported above the hub 30 by a member 91, which extends across upper edges of the rear side rail 60B. The wheel 90 is further supported by a rod 92 extending through the lap counting wheel 90 and the member 91. The lap counting wheel 90 rotates about the rod 92. The lever 80 extends along a centerline of the middle and rear portions 30B and 30C of the hub 30 and is anchored to the bottom plate 32 by a connector 81 about which the lever 80 rotates when impacted by one of the vehicles. The lever 80 is rotatable in both clockwise and counter-clockwise directions. Further, the lever 80 is temporarily magnetically anchored in the middle portion 30B along the centerline of the hub 30 by a magnetic coupling which may be formed of a magnet 82 disposed in the lever 80 and a metallic yoke 82 disposed in the hub. In this manner, the lever 80 as shown extends from the connector 81 in a direction toward the magnet/yoke 82 and the tracks 40. In this orientation, the lever 80 also extends oppositely beyond the connector 81 toward the rear side rail 60B of the rear portion 30C of the hub 30. Accordingly, the lever 80 includes a rotatable member which is bisected by and rotates about the connector 81 and is configured to maintain an orientation aligned with the centerline of the hub 30 when not in motion from impact of the toy vehicles.

As discussed, during an operation of the racing play set 10, the lever 80 is generally held by the magnetic arrangement inline with the centerline of the hub 30. When a vehicle impacts the rear portion of the lever 80 proximate to the rear side rail 60B, the vehicle rotates the lever 80 by 180 degrees while the vehicle makes its turn through the hub 30. As the vehicle exits the hub 30 and is rejoined with its track 40, the rotated lever 80 is, again, positioned by the magnetic arrangement inline with the centerline of the hub 30. Here, for example, the magnet may be set in the bottom plate 32 and the yoke may be found in the material of the lever 80 itself. As mentioned, the lever 80 is configured to maintain this centerline position unless acted upon by a passing toy vehicle.

A gear 83, which is coaxial with the connector 81, transfers the rotation of the lever 80 to the lap counting wheel 90 via teeth or threads 84 cut into the outer edges of the gear 83 and the lap counting wheel 90. In an embodiment of the invention, the threads 84 are timed such that a 180 degree rotation of the lever 80 in either direction corresponds to a single point on the lap counting wheel 90 in either direction.

A scoring indicator 100, such as a flag, is supported above the lap counting wheel 90 by a supporting structure 101. When the race is won by one of the players, the lap counting wheel causes a tripping knob 102 to knock the flag 100 over toward the winning player and thus dramatically signal the end of the race.

Figure 6:
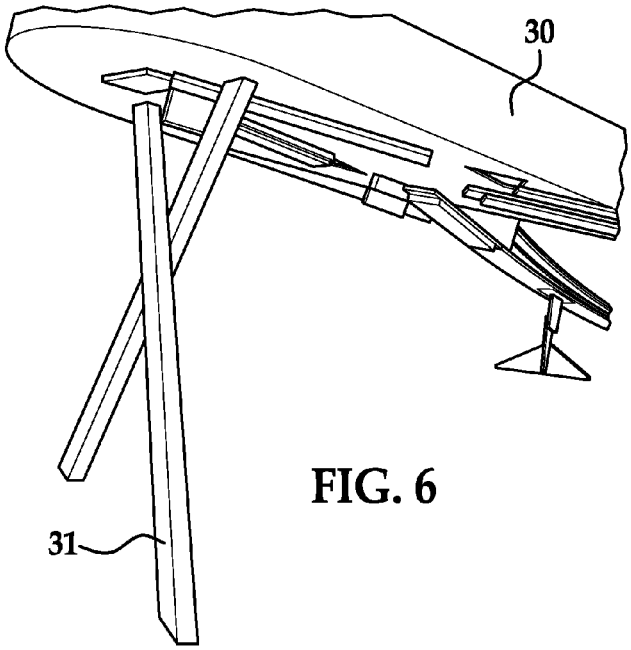
FIG. 6 illustrates a bottom perspective view thereof.

The hub 30 is supported at the elevated position by a hub pedestal 31, as shown in FIG. 6. As with the track pedestals 21, the hub pedestal 31 maintains the position of the hub 30 during the operation of the racing play set 10. According to an embodiment of the invention, the elevation provided by the track pedestals 21 and the hub pedestal 31 may be adjusted. This elevation generally allows for an expeditious gravity-fed return of the toy vehicles from the hub 30 to the launchers 50.

In accordance with the embodiments described above, the lap counting wheel 90 records a score for a player every time the player's vehicle rotates the lever 80 by 180 degrees. Conversely, the other player can prevent such scoring by timing his/her control of the launcher 50 to cause his/her vehicle to collide with the other vehicle at the intersection of the tracks 40 in the forward portion 30A of the hub 30 or in the shared curve track sections located at the middle and rear portions 30B and 30C of the hub 30 before the other vehicle completes the 180 degree rotation of the lever 80. Moreover, due to the configuration of the lap counting wheel 90, a lap scored for a first player increases his/her score by one count while at the same time reduces a second opposing player's score by one point. This provides for exciting head-to-head competition and allows for dramatic comebacks to be staged by a losing player. For example, player A may be leading player B by four scores and may only need one additional score to reach the limit of the counting wheel, five, to thus win the game. However, with four successful scores, player B may advance the counting wheel four places thus detracting four scores from player and rending the score equal. Player A would then navigate five successful labs through the hub to secure the victory.

It is noted that other embodiments of the invention are possible. For example, the lever 80 and lap counting wheel 90 could geared to keep separate counts of each vehicle's successful passes. That is, the lever 80 and wheel 90 could be configured to record a lap for a first vehicle when the lever is successfully rotated clockwise and further configured to record a lap for a second vehicle when rotated counter-clockwise. Here a lap may be counted upon a one-hundred eighty degree revolution of the lever 80, or ninety degrees, forty-five degrees, etc. In this exemplary embodiment, the only way one player can prevent the other player from scoring is by timing his/her control of the launcher 50 to cause the vehicles to collide at the hub 30.

The described lap counting wheel 90 and lever 80, and their various embodiments, are simply provided by way of non-limiting example only. The counting wheel 90 and lever 80 and associated gearing compose a scoring mechanism which in accordance with the broad scope of the invention, may include any sufficient mode or structure. For example, the scoring mechanism may be electronic and the hub 30 may include sensors configured to recognize a successful pass of a toy vehicle through the hub 30. In such configuration, the hub 30 may further include a display, such as an LED or LCD panel, etc., to indicate the score. Here, the hub 30 may further include a processor with memory functionality to store and/or process the score so as to replicate the described scoring technique where a scored lap for one player detracts a previously scored lap of a second player. Furthermore, beyond the described lever arrangement, any number of possible gate-type configurations are possible. For example, a single gate may be disposed in the rear portion 30C of the hub 30 in the shared curved track. A first vehicle strikes the gate in a first direction moving the gate correspondingly. A second competing vehicle would naturally maneuver the gate oppositely. This scoring mechanism would tally the opposing movements of the gate in order to develop respective laps scores and would further indicate an eventual winner. A mentioned, the invention provides an indication of the winner, for example, by dropping the flag arrangement 100. Any other visual indication may be used as well as an auditory and/or tactile indication such as a sounded tone or a vibration of the play set 10 or a portion thereof.

In further embodiments of the invention, it is noted that the lengths of the arms 20 and tracks 40 could be equal or, in order to increase difficulty for one of the players, unequal. Similarly, while the amount of elevation of the hub 30 may be adjusted; the racing play set 10 could also be tilted to one side or another. Further, the hub 30 could include additional intersections and turns while the arms 20 and the tracks 40 could include stunts, such as twists, turns, loops or jumps that would add excitement to the race and increase the challenge of having to sufficiently launch the vehicles to traverse the tracks 40.

In still further embodiments of the invention, the play set 10, i.e., the launchers 50, the turnstile mechanism 70 and/or the lap counting wheel 90, could include electronic or other automatic devices. For example, the launchers 50 have herein been described as manually activated. However, in another embodiment, the launchers 50 may be electronically driven, pneumatically activated, etc. Further, the launchers 50 can include motorized booster wheel assemblies to accelerate toy vehicles along the tracks 40.

In a further embodiment, the racing play set of the invention may include additional launchers with corresponding additional track segments in one intersecting turn-around hub so that one, two, three or more players are able to engage the racing play set.

Figure 7A:
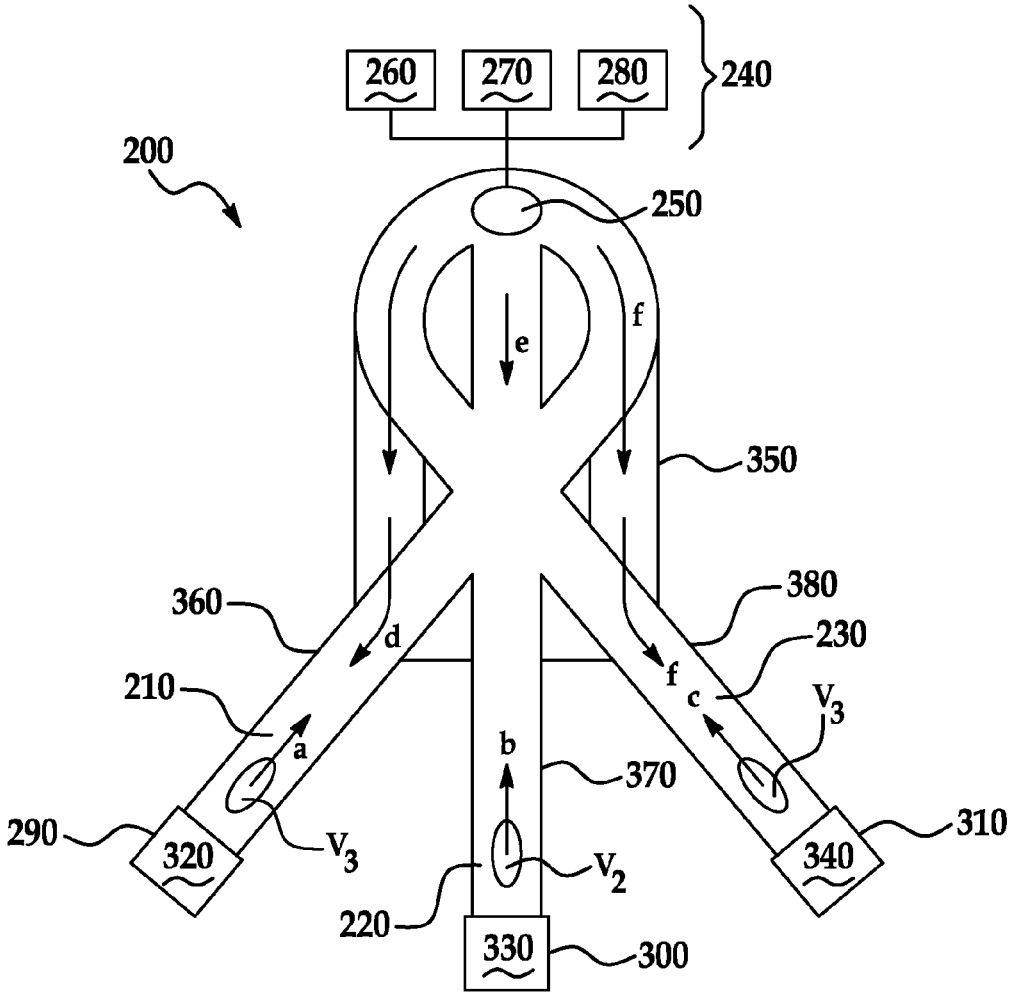
FIGS. 7A and 7B illustrate a racing play set in accordance with another embodiment of the invention.
Figure 7B:
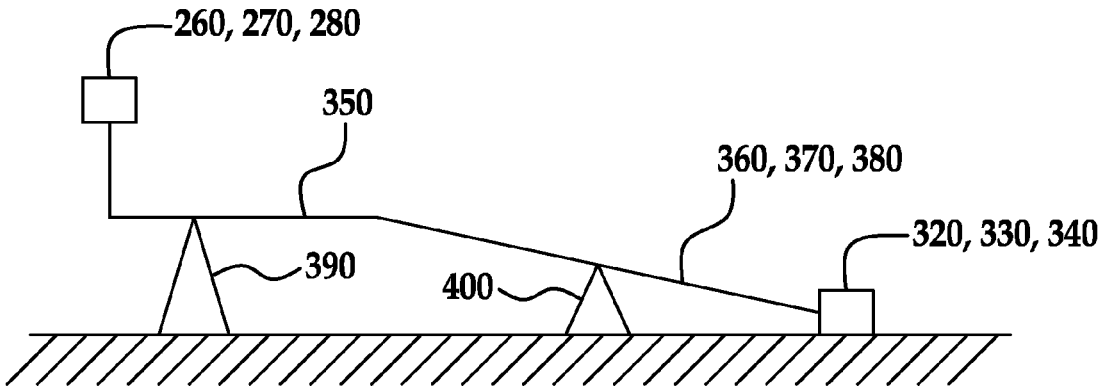

For example, with reference to FIGS. 7A-7B, a racing play set 200 includes a plurality of converging tracks 210, 220 and 230, which intersect at least once, along which vehicles V1, V2 and V3 travel in initially convergent directions a, b and c and then, if any of the vehicles do not collide with any other vehicles, in divergent directions d, e and f, respectively. A scoring apparatus 240, includes a target 250 that is actuated by a leading non-colliding vehicle to record a score for the corresponding player on corresponding respective scoreboards 260, 270 and 280. The target 250 may be similar to the lap counting wheel 90 and/or the fever 80 and/or the any of the additional exemplary embodiments discussed herein and/or contemplated by the invention. The scoring apparatus 240 may further detract a score from one or more of the other competing vehicles upon registering a score for the leading non-colliding vehicle. Launchers 320, 330 and 340 are located at launching positions 290, 300 and 310 of each track, respectively. Each vehicle starts from the launching positions 290, 300, 310 and non-colliding vehicles return thereto. At the launching positions 290, 300, 310 each launcher 320, 330, 340 is selectively actuated by the corresponding player to propel the respective vehicle in the respective convergent directions in the manner discussed with respect to the previous embodiments. Subsequent to a collision derailing any vehicle from its track, the corresponding player resets the derailed vehicle at the corresponding launching position.

The tracks 210, 220 and 230 are supported by a hub 350, on which the scoring apparatus is supported, and a plurality of arms 360, 370 and 380 coupled to the hub that each correspond to a single track. The launching position 290, 300 and 310 of each track is located at distal ends of the tracks. The hub 350 is elevated from a supporting surface by a hub pedestal 390 and the arms 360, 370 and 380, which are supported by arm pedestals 400, descend from the hub 350 such that each non-colliding vehicle returns to the launching position by way of forward momentum and gravity.

The racing play set is disclosed herein as including a track configuration which returns a toy vehicle from a successful pass through the hub down a straight track to the its origin where the vehicle may be launched again up the straight track into the hub. In an alternate embodiment, a continuous loop track arrangement may be provided where a vehicle that successfully passes through the hub may trace e.g. an oval pattern to return to the launcher where the vehicle may then be again propelled by action of the launcher. Here, the vehicle may be temporarily halted at the launcher or it may move continuously through the launcher in which case activation of the launcher must be precisely timed.

As mentioned, the described racing play set play set may be configured for miniature non-motorized toy vehicles such as, for example, 1/64 sized die cast metal cars. Of course the racing play set may be configured for any moving toy such as rolling or sliding figurines, rolling balls, etc.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A racing play set for toy vehicles, comprising:

a hub;

a first track segment having a first end and a second end, the second end of the first track segment communicating with the hub at a first location;

a second track segment having a first end and a second end, the second end of the second track segment communicating with the hub at a second location, the second location being different from the first location;

a return portion located in the hub and in communication with the first and second track portions; and a scoring mechanism configured to be actuated as toy vehicles pass through the return portion in opposite directions;

wherein the return portion is configured to receive a first toy vehicle from the first track segment and return the first toy vehicle to the first track segment; and wherein the return portion is configured to receive a second toy vehicle from the second track segment and return the second toy vehicle to the second track segment.

2. The racing play set of claim 1, wherein the scoring mechanism is further configured to detract a pass of one of the first and second toy vehicles when recording a pass for the other.

3. The racing play set of claim 1, wherein the return portion comprises a curved track segment configured such that the first and second vehicles travel therethrough in opposing directions.

4. The racing play set of claim 3, wherein the scoring mechanism comprises a turnstile at least partially disposed in the return portion and wherein the turnstile is capable of movement in the direction of the first and second toy vehicles.

5. The racing play set of claim 4, wherein the turnstile comprises a rotatable lever extending into the return portion in a path of travel of the first and second toy vehicles and wherein the lever is configured to rotate out of the path of travel when impacted by the first and second toy vehicles and wherein the lever is configured to return to the path of travel after either one of the first or second toys vehicles passes through the return portion.

6. The racing play set of claim 5, wherein the scoring mechanism further includes a counting wheel coupled to and driven by movement of the lever, the lever and the counting wheel configured to move in opposite directions corresponding to the directions of travel of the first and second toy vehicles through the return portion, the counting wheel including indicia to indicate a score.

7. The racing play set according to claim 1, wherein the hub is elevated from a surface and the first track segment and the second track segment descend from the hub toward the surface.

8. The racing play set according to claim 7, wherein the return portion comprises:

a curved track portion having one end coupled to the second end of the first track segment and another end coupled to the second end of the second track segment; and a pair of generally straight track portions each being coupled to the second end of either one of the first and second track segments and the curved track portion, wherein the first toy vehicle and the second toy vehicle enter the return portion from the curved track portion and exit the return portion from one of the pair of generally straight track portions.

9. The racing play set according to claim 1, further comprising a launcher arrangement located at the first end of the first track segment and the first end of the second track segment, wherein each launcher arrangement is configured to selectively propel either the first toy vehicle or the second toy vehicle on either one of the first and second track segments towards the return portion.

10. The racing play set according to claim 1, wherein the scoring mechanism comprises:

a lever configured to be actuated by either one of the first and second vehicles as they pass through the return portion in opposite directions; and a counting wheel coupled to the lever, the counting wheel being configured to indicate that a vehicle has travelled through the return portion and actuated the lever.

11. The racing play set according to claim 1, wherein the scoring mechanism further comprises a scoring indicator configured to provide an indication when a predetermined number of passes have been made by one of the first and second toy vehicles.

12. The racing play set of claim 1, further comprising a third track segment for a third toy vehicle, the third track segment having a first end and a second end, the second end of the third track segment communicating with the hub at a third location, the third location being remote from the first location and the second location, wherein the return portion is also in communication with the third track segment, and wherein the scoring mechanism is further configured to be actuated as the third toy vehicle enters the return portion from the third track segment.

13. A racing play set, comprising:

a hub having a forward portion and a return portion coupled to and disposed rearward of the forward portion;

a plurality of tracks each of which has a first end and a second end, the second end of each of the plurality of tracks being coupled to the forward portion, the forward portion being configured to receive movable toys from each second end of each of the plurality of tracks, the return portion being configured to receive the movable toys from the forward portion in opposite directions and return the movable toys to a respective one of the plurality of tracks via the forward portion;

a scoring apparatus that is actuated by the movable toys that are received by the return portion;

a launcher for each of the plurality of tracks and for propelling the movable toys from the first end of each of the plurality of tracks towards the forward portion of the hub; and wherein movable toys entering the forward portion of the hub from either the second end of anyone of the plurality of tracks or the return portion of the hub may collide with each other in the forward portion of the hub.

14. The racing play set according to claim 13, wherein each launcher is configured to be manually actuated by a player.

15. The racing play set of claim 14, wherein the hub is elevated from a supporting surface and the plurality of tracks descend from the hub such that each movable toy entering the second end of one of the plurality of tracks from the forward portion of the hub returns to the first end of the one of the plurality of tracks and wherein the movable toys are toy cars.

16. The racing play set of claim 13, wherein the return portion comprises a curved track portion to receive the movable toys from the forward portion.

17. The racing play set of claim 13, wherein impact of a first moveable toy with a second movable toy in the forward portion prior to either the first movable toy or the second movable toy entering the return portion will prevent either the first movable toy or the second movable toy from actuating the scoring apparatus.

18. The racing play set of claim 13, wherein the scoring mechanism is configured to record a score for a first player when a movable toy of the first player enters the return portion from the forward portion in a first direction and wherein the scoring mechanism is configured to record a score for a second player when a movable toy of the second player enters the return portion from the forward portion in a second direction the second direction being opposite to the first direction and wherein the score for either the first player or the second player will reduce a previously recorded score for either the first player or the second player.

19. A racing play set for non-motorized toy vehicles, comprising:

a plurality of track segments, each having corresponding first and second ends;

launcher arrangements disposed at the respective first ends of the track segments and configured to allow selective propulsion of the toy vehicles traveling on the track segments in a direction toward the second ends;

a hub disposed at the second ends of the track segments and comprising an intersection portion where the track segments converge and a return portion comprising a single track configured to receive the toy vehicles in opposite directions from the intersection portion and configured to redirect the toy vehicles back toward a respective one of the plurality of track segments from which the toy vehicles were launched; and a scoring mechanism configured to indicate a score to a vehicle which passes through at least one of the intersection portion and the return portion and further configured to correspondingly detract a previously recorded score from another vehicle.

20. The racing play set of claim 19, wherein the plurality of track segments comprise first and second track segments, the launcher arrangements are manually actuated, and the single track of the return portion is a substantially U-shaped curved track portion, and the scoring mechanism is configured to provide an indication when one toy vehicles has accumulated a predetermine number of scores.

* * * * *